US006071222A

United States Patent [19]

Schneider

[11] Patent Number: 6,071,222

[45] Date of Patent: Jun. 6, 2000

[54] LENGTHWISE CUTTING AND GROOVING MACHINE FOR WEBS OF CORRUGATED BOARD

[75] Inventor: Stephan Schneider, Amberg, Germany

[73] Assignee: BHS Corrugated Maschinen-und Anlagenbau GmbH, Weiherhammer, Germany

[21] Appl. No.: 09/203,575

[22] Filed: Dec. 2, 1998

[30] Foreign Application Priority Data

Dec. 10, 1997 [DE] Germany ..... 197 54 799

[51] Int. Cl.[7] ..... B31B 1/14

[52] U.S. Cl. ..... 493/355; 493/403; 493/402; 493/365; 83/865; 83/876

[58] Field of Search ..... 493/355, 365, 493/356, 396, 399, 402, 403, 454; 83/863, 865, 876, 885, 864

[56] References Cited

U.S. PATENT DOCUMENTS

| | | | |
|---|---|---|---|
| 3,929,047 | 12/1975 | Brandi | 83/499 |
| 4,261,239 | 4/1981 | Toboshi et al. | 83/499 |
| 4,516,454 | 5/1985 | Mosburger | 83/499 |
| 4,563,930 | 1/1986 | Schommler et al. | 83/862 |
| 4,976,676 | 12/1990 | Mensing et al. | 493/365 |

FOREIGN PATENT DOCUMENTS

| | | |
|---|---|---|
| 81 32 018 | 2/1982 | Germany . |
| 8132018 | 2/1982 | Germany . |
| 32 02 914 | 8/1983 | Germany . |
| 3202914 | 8/1983 | Germany . |
| 38 26 993 | 2/1990 | Germany . |
| 3826993 | 2/1990 | Germany . |
| 42 26 075 | 2/1994 | Germany . |
| 4226075 | 2/1994 | Germany . |
| 08011245 | 1/1996 | Japan . |
| 08047987 | 2/1996 | Japan . |

OTHER PUBLICATIONS

Patent abstract of Japan, 08011245, published Jan. 16, 1996.
Patent abstract of Japan, 08047987, published Feb. 20, 1996.

*Primary Examiner*—Stephen F. Gerrity
*Assistant Examiner*—Sam Tawfik
*Attorney, Agent, or Firm*—Browdy and Neimark

[57] ABSTRACT

A lengthwise cutting and grooving machine for webs of corrugated board comprises a grooving station, a lengthwise cutting and grooving station and a lengthwise cutting station which are disposed one after the other in the conveying direction of a web of corrugated board. The lengthwise cutting and grooving station comprises a pair of a grooving tool and a counterpart grooving tool cooperating therewith on the one hand and a pair of a cutter and a counterpart tool on the other hand.

4 Claims, 4 Drawing Sheets

A
B
C
II
II 14
23
16
25
4
26
16'
24
14

LENGTHWISE CUTTING AND GROOVING MACHINE FOR WEBS OF CORRUGATED BOARD

BACKGROUND OF THE INVENTION

1. Field of the Invention

The invention relates to a lengthwise cutting and grooving machine for webs of corrugated board.

2. Background Art

A machine of the generic type is known from U.S. Pat. No. 4,976,676, in which several stations with cutters on the one hand and grooving tools on the other are provided in the conveying direction of the respective web of corrugated board. Tool holders are provided in one station, each holding two tools, i.e. either cutters or grooving tools. In case cutters or grooving tools are used, one tool may be provided as a replacement part. If grooving tools are provided, they may have varying grooving profiles.

Lengthwise cutting and grooving machines for webs of corrugated board are known to comprise grooving tools and counterpart grooving tools in two stations disposed successively relative to the conveying direction of the web of corrugated board. A third station is equipped with cutters for the lengthwise cutting of the web of corrugated board. The fundamental problem of lengthwise cutting and grooving machines of the generic type resides in that a rapid change of format or a rapid change of the grooving is feasible only at comparatively low conveying speeds of the web of corrugated board.

SUMMARY OF THE INVENTION

It is the object of the invention to ensure a rapid change of format and also a rapid change of the grooving profiles to be possible even at high conveying speeds of the web of corrugated board of more than 150 m/min.

According to the invention, this object is attained in a lengthwise cutting and grooving machine for webs of corrugated board, comprising a machine frame; a grooving station disposed in the machine frame and having several tool holders, which are allocated to each other in pairs, which are displaceable crosswise to the conveying direction of a web of corrugated board, and which are provided with a pair of a grooving tool and a counterpart grooving tool cooperating therewith, which grooving tool and counterpart grooving tool are movable in pairs towards each other, engaging the web of corrugated board, and away from each other; a lengthwise cutting and grooving station disposed in the machine frame and having several tool holders, which are allocated to each other in pairs, which are displaceable in pairs crosswise to the conveying direction of the web of corrugated board, and which are provided with a pair of a grooving tool and a counterpart grooving tool cooperating therewith, which grooving tool and counterpart grooving tool are movable in pairs towards each other, engaging the web of corrugated board, and away from each other, and which tool holders are provided with a pair of a cutter and a counterpart tool which are movable towards each other, engaging the web of corrugated board, and away from each other in pairs and in a direction opposite to the respective grooving tool and counterpart grooving tool; and a lengthwise cutting station disposed in the machine frame and having several tool holders, which are allocated to each other in pairs, which are displaceable in pairs crosswise to the conveying direction of the web of corrugated board, and which are provided with a pair of a cutter and a counterpart tool cooperating therewith, which cutter and counterpart tool are movable in pairs towards each other, engaging the web of corrugated board, and away from each other. If the web of corrugated board is not grooved, a change of format can be carried out even at extremely high conveying speeds of up to 250 m/min, since the cutters used during the format change can be pre-positioned. Correspondingly, in the case of a change of the grooving profile, a second grooving profile can be inserted by quick change after corresponding pre-positioning. A further grooving profile may also be inserted after the change of the grooving profile, however without pre-positioning.

Further features, advantages and details of the invention will become apparent from the ensuing description of an exemplary embodiment, taken in conjunction with the drawing.

DESCRIPTION OF THE PREFERRED EMBODIMENT

Figure 1:
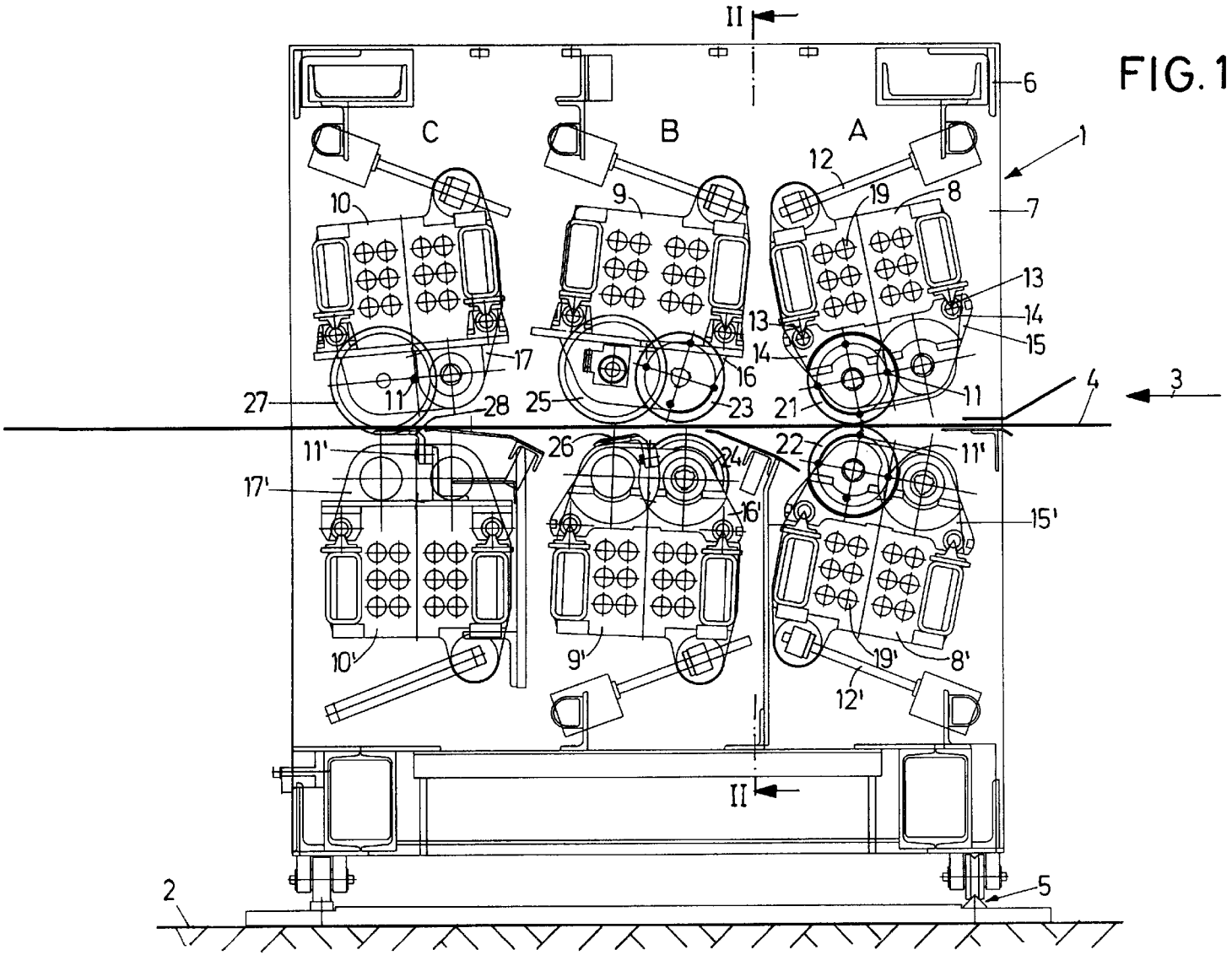
FIG. 1 is a vertical cross-sectional view of a machine according to the invention on the section line I—I of FIG. 2.

The lengthwise cutting and grooving machine seen in the drawing comprises a machine frame 1 which is essentially stationary and which supports itself on the ground 2 via a horizontal, transverse follow-up device 5 oriented crosswise to the conveying direction 3 of a web of corrugated board 4. The machine frame 1 possesses lengthwise beams 6 which are horizontal and extend crosswise to the conveying direction 3 and which are joined to each other at their ends by side walls 7, 7'.

In the machine frame 1, namely between the side walls 7, 7', three pairs of tool beds 8, 8', 9, 9', and 10, 10' are lodged pivotally about a pivot axis 11, 11'. The tool beds 8, 8', 9, 9', and 10, 10' are disposed in pairs one above the other approximately in mirror symmetry to the web of corrugated board 4 which they accommodate between them. The pivot axes 11, 11' are run in the side walls 7, 7'. Pivoting of the tool beds 8, 8', 9, 9', and 10, 10' about the pivot axes 11, 11' is effected by pivot drives 12, 12' in the form of spindle nut drives.

On the sides, turned towards the web of corrugated board 4, of the tool beds 8, 8', 9, 9', and 10, 10', guideways 13 are provided, on which tool holders 15, 15', 16, 16', and 17, 17' allocated to each other by twos are lodged to be displaceable horizontally and crosswise to the conveying direction 3 by means of guide blocks 14. The first tool holders 15, 15', seen in the conveying direction 3, which are allocated to each other by twos, belong to a grooving station A. The central pairs of tool holders 16, 16' belong to a lengthwise cutting and grooving station B. The last pairs of tool holders 17, 17', seen in the conveying direction 3, belong to a lengthwise cutting station C.

Figure 2:
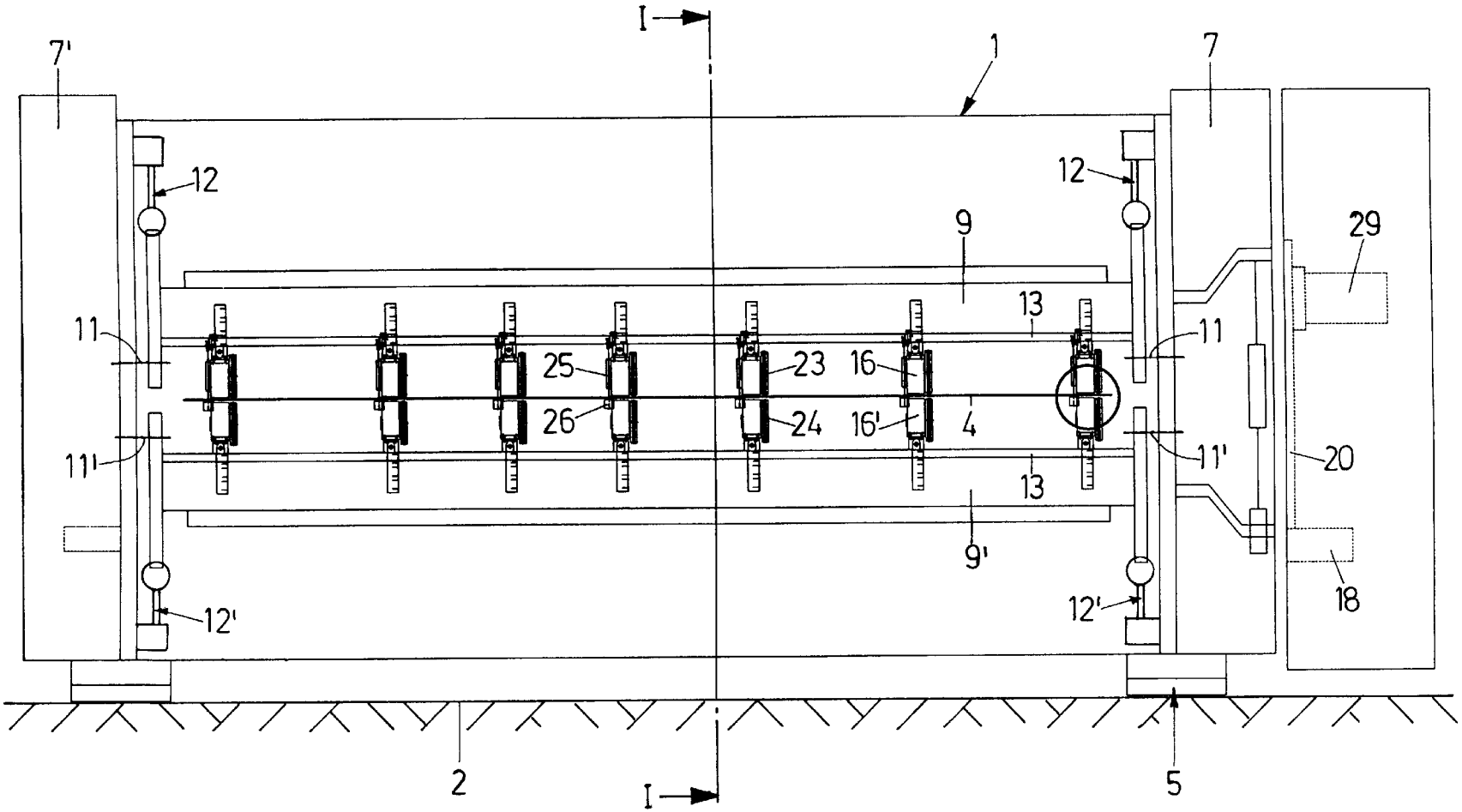
FIG. 2 is a vertical cross-sectional view of the machine on the section line II—II of FIG. 1.
Figure 3:
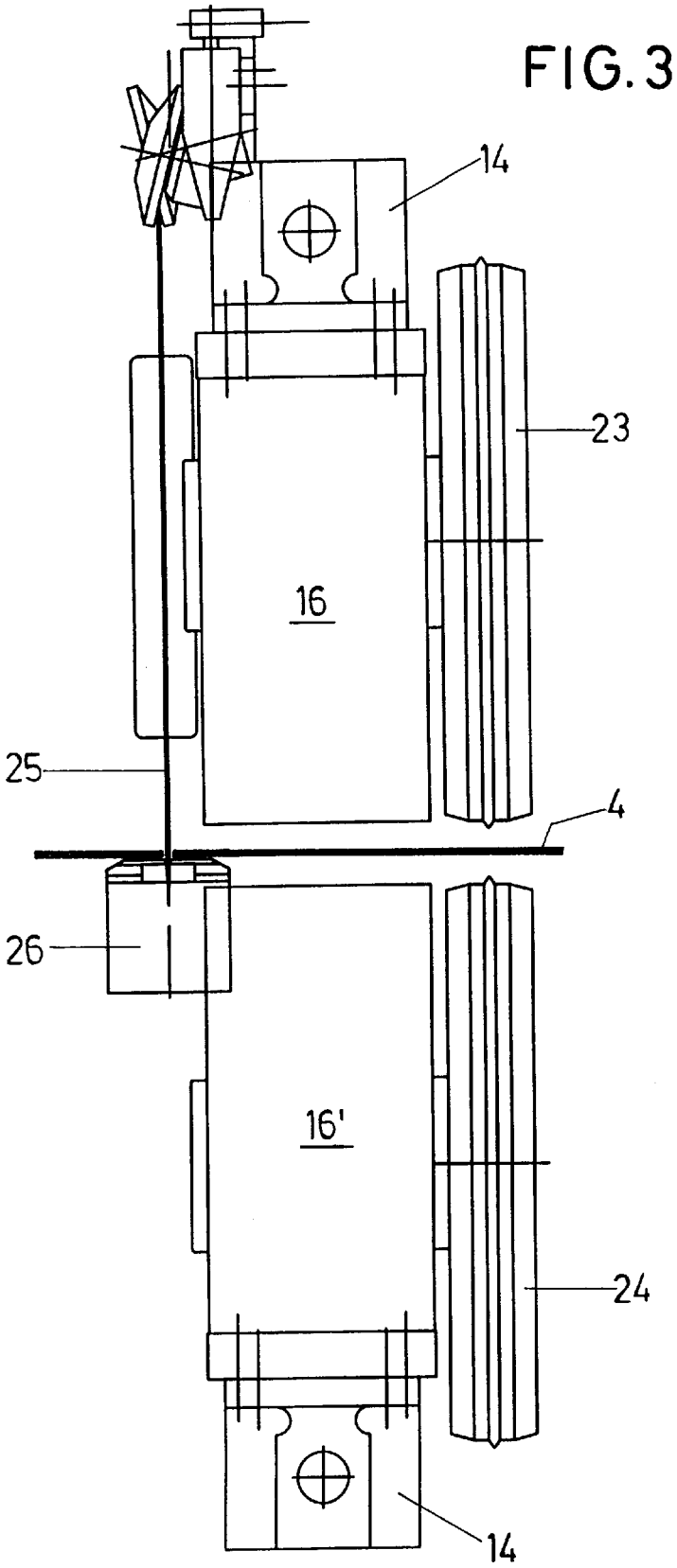
FIG. 3 is a view of a pair of tool holders with grooving tools and cutters.

Crosswise adjustment of the pairs of tool holders 15, 15' and 16, 16' and 17, 17', respectively, is effected for each pair of tool holders 15, 15' and 16, 16' and 17, 17', respectively, by a crosswise adjusting motor 18 and by setting shafts 19, 19' allocated to each tool holder 15, 15', 16, 16', and 17, 17', the two setting shafts 19, 19' allocated to a pair of tool holders 15, 15' and 16, 16' and 17, 17', respectively, being coupled with each other by a synchronous belt drive 20. Numerous pairs of tool holders 15, 15', 16, 16' and 17, 17' being available, this will give a high number of setting shafts 19, 19' allocated to each other by twos. FIG. 2 only illustrates a motor 18 having a synchronous belt drive 20 for a single pair of tool holders 16, 16'.

On the tool holders 15 allocated to the grooving station A and disposed above the web of corrugated board 4, provision is made for a grooving tool 21 to which is allocated a counterpart grooving tool 22 supported on the tool holder 15' located below the web of corrugated board 4. Correspondingly, grooving tools 23 and counterpart grooving tools 24 are supported on the tool holders 16, 16' allocated to the station B. Furthermore, a cutter 25 is rotatably supported on these tool holders 16, having a counterpart holding table 26 on the lower tool holder 16' allocated to it. Corresponding cutters 27 and counterpart holding tables 28 are provided on the tool holders 17 and 17' of the station C.

The grooving tools 21, 23 and the counterpart grooving tools 22 and 24 on the one hand and the cutters 25, 27 on the other are driven in rotation by driving motors 29 which are mounted on the side walls 7, 7' as are the motors 18 and of which only one is seen in FIG. 2.

By means of the pivot drives 12 and 12', respectively, the grooving tools 21 and the counterpart grooving tools 22 of the grooving station A can be moved into a position of engagement and grooving seen in FIG. 1, in which a groove is produced in the web of corrugated board 4 transported in the conveying direction 3 by means of each pair of grooving tools 21 and counterpart grooving tools 22. They are further pivotal into a position (not shown) in which the grooving tools 21 and the counterpart grooving tools 22 disengage the web of corrugated board 4.

Figure 6:
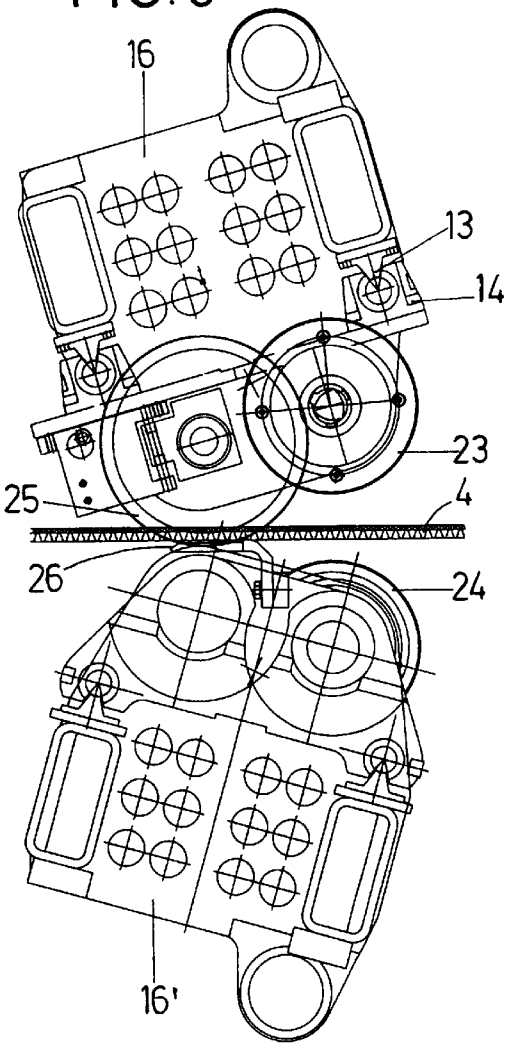
FIG. 6 is an illustration of the station of FIGS. 4 and 5 with cutters in engagement.
Figure 5:
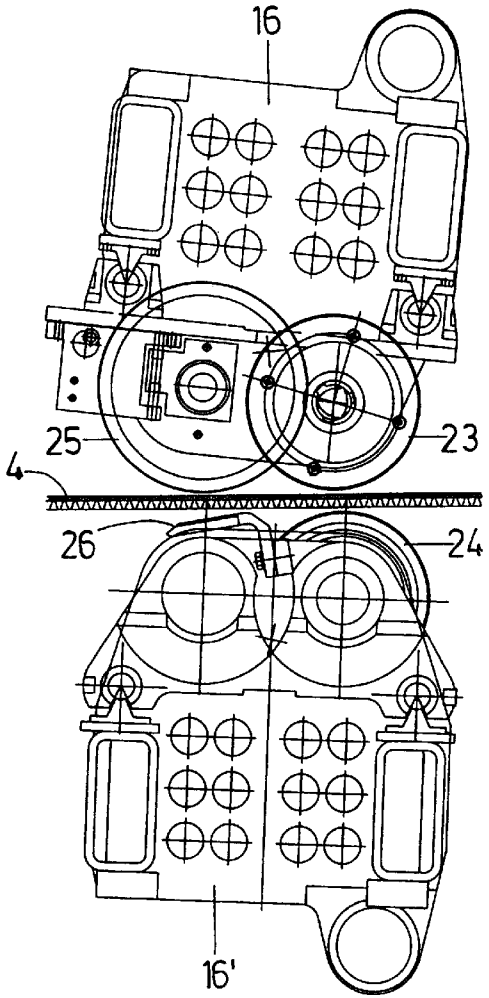
FIG. 5 is an illustration of the station of FIG. 4 with cutters and grooving tools disengaged.
Figure 4:
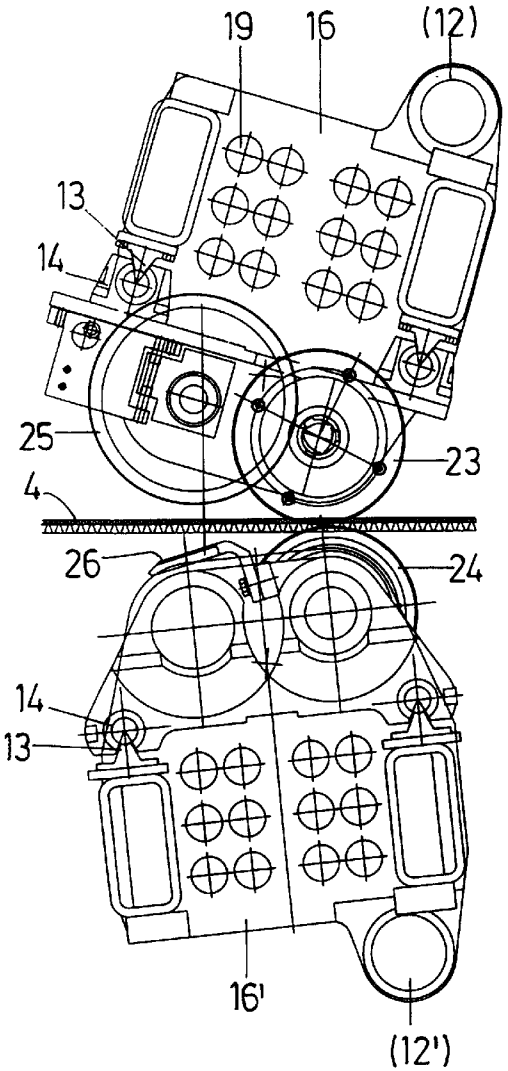
FIG. 4 is a vertical cross-sectional view of a lengthwise cutting and grooving station of the machine with grooving tools and counterpart grooving tools in engagement.

By means of the pivot drives 12 and 12' allocated to them, the station B tool holders 16, 16' can be pivoted into three positions corresponding to the illustrations of FIGS. 4 to 6, namely a first position seen in FIG. 4 in which the grooving tools 23 and the counterpart grooving tools 24 by twos are in engagement with the web of corrugated board 4, producing a groove. In this case the cutters 25 and the counterpart holding tables 26 are in disengagement from the web of corrugated board 4. In the position of the tool holders 16, 16' seen in FIG. 5, the grooving tools 23 and the counterpart grooving tools 24 as well as the cutters 25 and the counterpart holding tables 26 of the station B are not in engagement with the web of corrugated board 4. In a third position seen in FIG. 6, the grooving tools 23 and the counterpart grooving tools 24 disengage the web of corrugated board 4, whereas the cutters 25 move into the web of corrugated board 4, cutting same lengthwise. By pivoting—clockwise in FIG. 6—the cutters 27 and the counterpart holding tables 28 are moved into disengagement from the web of corrugated board 4.

If the web of corrugated board 4 is cut only lengthwise, i.e. if no grooves are produced, then a change of format, i.e. a change of the width of the individual partial webs cut from the web of corrugated board 4, can take place even at high conveying speeds of the web of corrugated board 4, since the cutters 25 and the counterpart holding tables 26 or the cutters 27 and the counterpart holding tables 28 of the stations B and C, which are not in operation, can be pre-positioned to be in disengagement from the web of corrugated board 4. Then they are moved into engagement and simultaneously the cutters 27 and the counterpart holding tables 28 or the cutters 25 and the counterpart holding tables 26 of the stations C and B are disengaged.

Correspondingly, quick change of the grooving profiles is possible, i.e. the grooving tools 21 and the counterpart grooving tools 22 of the station A or the grooving tools 23 and the counterpart grooving tools 24 of the station B can be pre-positioned and moved into engagement in quick change, the grooving tools 23 and the counterpart grooving tools 24 of the station B or the grooving tools 21 and the counterpart grooving tools 22 of the station A then being simultaneously disengaged. Subsequently, the pairs of grooving tools 23 and counterpart grooving tools 24 of the station B or the grooving tools 21 and the counterpart grooving tools 22 of the station A, which have been disengaged during the quick change, can be moved into engagement with the web of corrugated board 4—however without pre-positioning—for the production of further grooves.

What is claimed is:

1. A lengthwise cutting and grooving machine for webs of corrugated board, comprising a machine frame (1);

a grooving station (A) disposed in the machine frame (1) and having several tool holders (15, 15'), which are allocated to each other in pairs, which are displaceable crosswise to a conveying direction (3) of a web of corrugated board (4), and which are provided with a pair of a first grooving tool (21) and a first counterpart grooving tool (22) cooperating therewith, which are movable in pairs towards each other, engaging the web of corrugated board (4), and away from each other;

a lengthwise cutting and grooving station (B) disposed in the machine frame (1) and having several tool holders (16, 16'), which are allocated to each other in pairs, which are displaceable in pairs crosswise to the conveying direction (3) of the web of corrugated board (4), and which are provided with a pair of a second grooving tool (23) and a second counterpart grooving tool (24) cooperating therewith, which are movable in pairs towards each other, engaging the web of corrugated board (4), and away from each other, and which are provided with a pair of a first cutter (25) and a first counterpart tool (26), which are movable towards each other, engaging the web of corrugated board (4), and away from each other in pairs;

wherein when the grooving tool (23) and the second counter part grooving tool (24) are moved towards each other, the first cutter (25) and the first counterpart tool (26) are moved apart from each other, and when the first cutter (25) and the first counter part tool (26) are moved toward each other, the grooving tool (23) and the second counterpart (24) are moved apart from each other; and a lengthwise cutting station (C) disposed in the machine frame (1) and having several tool holders (17, 17'), which are allocated to each other in pairs, which are displaceable in pairs crosswise to the conveying direction (3) of the web of corrugated board (4), and which are provided with a pair of a second cutter (27) and a second counterpart tool (28) cooperating therewith, which are movable in pairs towards each other, engaging the web of corrugated board (4), and away from each other.

2. A lengthwise cutting and grooving machine according to claim 1, wherein the second grooving tools (23) and the second counterpart grooving tools (24) and the first cutters (25) and the first counterpart tools (26) of the lengthwise cutting and grooving station (B) are simultaneously moveable into disengagement from the web of corrugated board (4).

3. A lengthwise cutting and grooving machine according to claim 1, wherein the lengthwise cutting and grooving station (B) is arranged between the grooving station (A) and the lengthwise cutting station (C).

4. A lengthwise cutting and grooving machine according to claim 1, wherein the second grooving tool (23) and the first cutter (25) are each rotatably engaged on a first of said tool holders (16) and the second counterpart grooving tool (24) and the first counterpart tool (26) are each engaged on a second of said tool holders (16').

* * * * *